US005224628A

United States Patent [19]

Keller

[11] Patent Number: 5,224,628

[45] Date of Patent: Jul. 6, 1993

[54] DISPENSING APPARATUS FOR USE WITH TWIN CARTRIDGES

[76] Inventor: Wilhelm A. Keller, Grundstrasse 12, 6343 Rotkreuz, Switzerland

[21] Appl. No.: 681,009

[22] Filed: Apr. 5, 1991

[30] Foreign Application Priority Data

Apr. 10, 1990 [CH] Switzerland ..... 01216/90-2

[51] Int. Cl.[5] ..... B67D 5/52

[52] U.S. Cl. ..... 222/137; 222/327; 222/386

[58] Field of Search ..... 222/137, 145, 325-327, 222/389, 391; 248/316.1, 316.7

[56] References Cited

U.S. PATENT DOCUMENTS

| | | | |
|---|---|---|---|
| 2,348,902 | 5/1944 | Hart | 248/316.1 |
| 3,369,714 | 2/1968 | Dewees et al. | 222/327 |
| 3,570,719 | 3/1971 | Schiff | 222/137 |
| 4,471,888 | 9/1984 | Herb et al. | 222/137 |
| 4,676,410 | 6/1987 | von Flue | 222/137 |
| 5,005,735 | 4/1991 | Keller | 222/327 |
| 5,054,655 | 10/1991 | Keller | 222/327 |

FOREIGN PATENT DOCUMENTS

| | | | |
|---|---|---|---|
| 291753 | 1/1985 | European Pat. Off. | 222/389 |

*Primary Examiner*—Andres Kashnikow
*Assistant Examiner*—Philippe Derakshani
*Attorney, Agent, or Firm*—McAulay Fisher Nissen Goldberg & Kiel

[57] ABSTRACT

The dispensing apparatus is used with twin cartridges that have two axially parallel storage cylinders and a nozzle piece connecting them. The apparatus has two plungers, one for each storage cylinder, guided to move longitudinally, and a holder for interchangeable cartridges which has a guide for the nozzle piece of a cartridge. To allow the use of two different types of cartridges, with cylinders of different diameter ratios, the holder is provided with a retention device designed to align the axes of the storage cylinders with those of the plungers; the retention device has separate grippers associated with each plunger, and these are dimensioned for different cylinder diameters. Different cartridges can be aligned between one of the grippers and the cylinder it grips, in conjunction with the guide for the nozzle piece, while the other gripper leaves the other cylinder free.

8 Claims, 2 Drawing Sheets

DISPENSING APPARATUS FOR USE WITH TWIN CARTRIDGES

BACKGROUND OF THE INVENTION a) Field of the Invention

The invention relates to a dispensing apparatus for use with twin cartridges that have two axially parallel storage cylinders and a nozzle piece connecting them; the dispensing apparatus has two plungers, one for each storage cylinder, which are guided to move longitudinally at a predetermined axial distance, and a holder for interchangeable cartridges, which has a guide for the nozzle piece of the cartridge.

b) Prior Art

The twin cartridges intended for use with the dispensing apparatus serve in a known manner for processing so-called two-component material. They consist of two storage cylinders which contain the components separately from each other, and a transport piston which closes the end of each cylinder opposite the nozzle. For use, a twin cartridge is inserted in the holder of the apparatus. Parallel motion or stroke of the two plungers of the apparatus exerts pressure on the transport pistons which are being advanced correspondingly, and this causes a given volume of the contents of each cylinder to be dispensed. The dispensed volume is determined by the cross-section of the cylinder and the stroke of the piston. U.S. Pat. No. 4,911,328 describes an example of such a dispensing apparatus and U.S. Pat. No. 4,981,241 describes an example of a twin cartridge of the kind referred to.

To ensure that the cartridges work properly, their cylinders must be aligned with the two plungers within the holder, i.e. the axes of the cylinders should coincide as nearly as possible with the axes of the plungers. This does not create any special difficulty as long as only cartridges are used in which the cylinders have always the same diameter; most twin cartridges used to date have generally had two identical cylinders for a 1:1 mixing ratio of the two components. However, some two-component systems need a different mixing ratio of their components and thus require twin cartridges of different cylinder cross-section or diameter.

SUMMARY OF THE INVENTION

An object of the present invention is the design of a dispensing apparatus as described which makes it suitable for use with cartridges of different kinds, the diameter ratios of whose two cylinders need not be the same, wherein there is no need of the holder to be modified but nevertheless the proper alignment of the cartridge cylinders is always ensured.

According to the invention, the holder of the dispensing apparatus is provided with retention means for aligning each storage cylinder of a cartridge separately with each plunger, the retention means having grippers associated with each plunger and dimensioned differently to receive storage cylinders of different diameters. With any type of cartridge, only one cylinder acts together with part of the grippers associated with the respective plunger, leaving the other part of the grippers free, whereas the guide for the nozzle piece contributes to the alignment of the cartridge.

A preferred embodiment of the dispensing apparatus according to the present invention is described and explained more specifically below in conjunction with the drawings.

BRIEF DESCRIPTION OF THE DRAWINGS

Referring to the drawings.

DETAILED DESCRIPTION OF THE INVENTION

Figure 1:
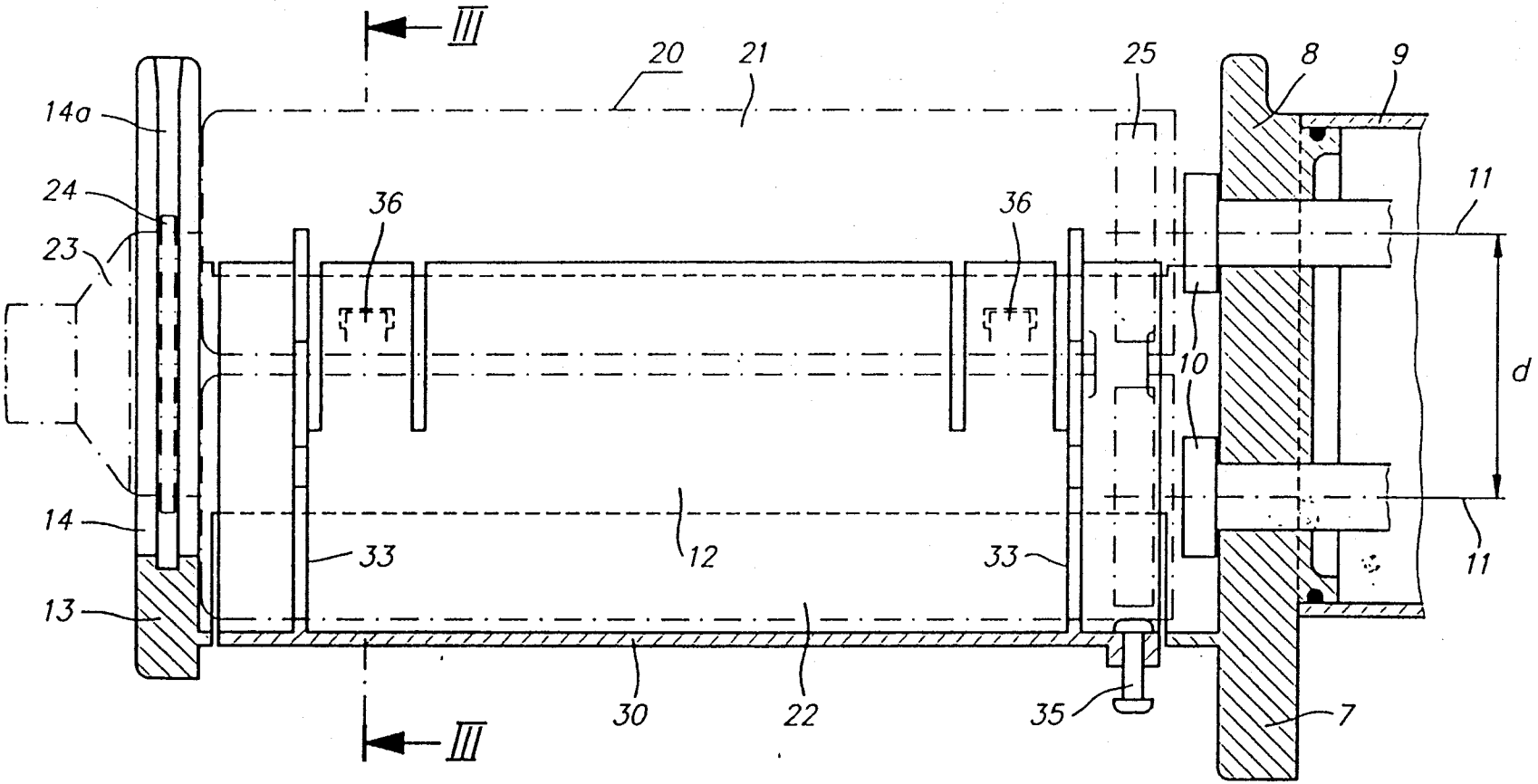
FIG. 1 is a longitudinal section of the holder of the dispensing apparatus, otherwise shown in part only, wherein an inserted twin cartridge is indicated in dot-dash lines.

The dispensing apparatus which is only partly shown has a head plate 8 in which two plungers 10 are guided to move longitudinally; d indicates the distance between the two plunger axes 11. In FIG. 1, the plungers 10 are shown in their retracted position, from where they are advanced to the left (as seen in FIG. 1) in order to actuate a twin cartridge 20. Only a small portion of the drive part (known per se) for the plungers 10 is shown on the right of the head plate 8 in FIG. 1. For example, the drive may be a pneumatic unit consisting of a cylinder and piston, whose cylinder 9 is fixed to the head plate 8 and whose piston (not shown) drives the two plungers 10. An extension 7 at the bottom of the head plate 8 is used to fit a handle (not shown) to the dispensing apparatus.

On the face of the head plate 8 opposite the plunger drive there is a holder for interchangeable twin cartridges 20. The main components of the holder are a face plate 13 and two parallel struts 12 that connect the face plate 13 to the head plate 8. The twin cartridge 20 inserted in the holder 12, 13 for use with the dispensing apparatus has two adjacent parallel storage cylinders 21, 22. At one end, the two cylinders are connected by a nozzle piece 23; at the other end they have two transport pistons 25, and each plunger 10 presses on one of these. Preferably, as shown in FIG. 1, the two cylinders 21, 22 are in addition connected to each other near the plunger end by spacers or other means.

Figure 2:
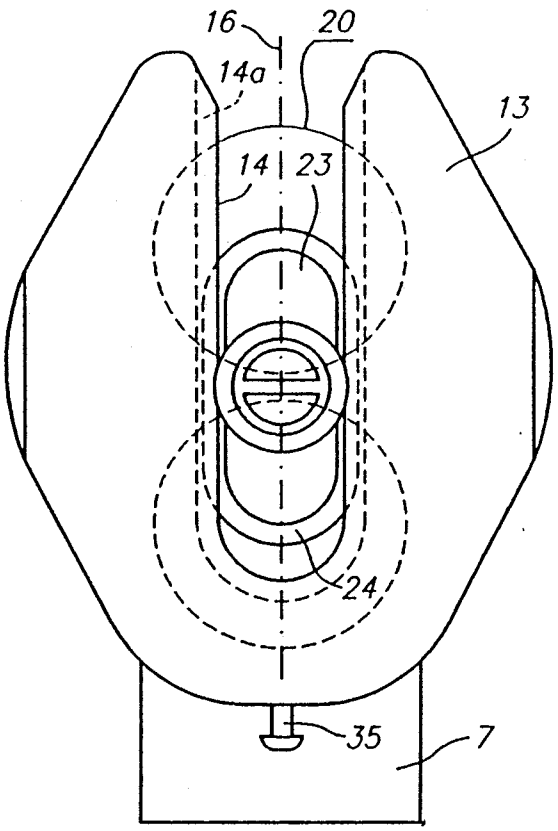
FIG. 2 is a front view of the arrangement shown in FIG. 1.

A vertical slot 14 in the face plate 13 acts as a guide for the nozzle piece 23 of the twin cartridge 20 held in the holder; in the example shown, the twin cartridge 20 is inserted from above. Thus the two axes of the cylinders lie above each other in the same vertical plane 16, as shown in FIG. 2; the two plunger axes 11 also lie in this plane. The axial distance of the storage cylinders 21, 22 is at least approximately the same as that of the two plungers 10. For positioning the twin cartridge 20 in the direction of the cylinder and plunger axes, the nozzle piece 23 has a peripheral flangelike rib 24 that engages in a groove 14*a* to slot 14.

Figure 3B:
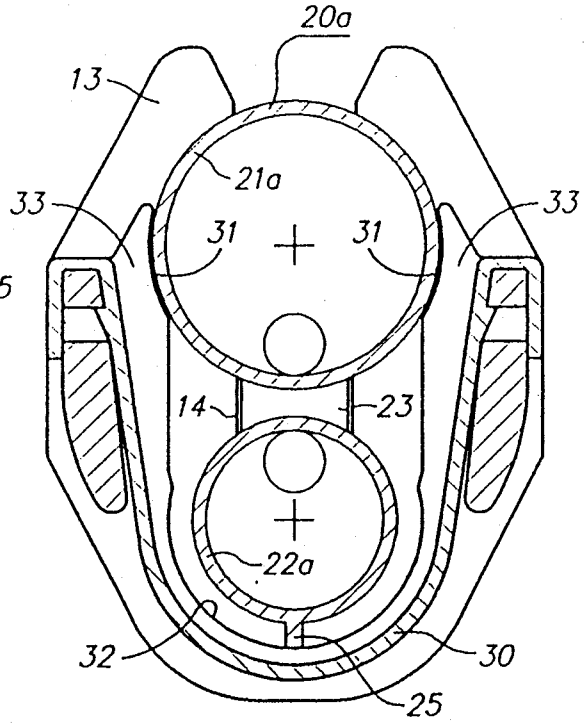
FIG. 3*b* is a similar section but shows a different type of twin cartridge inserted in the holder.
Figure 3A:
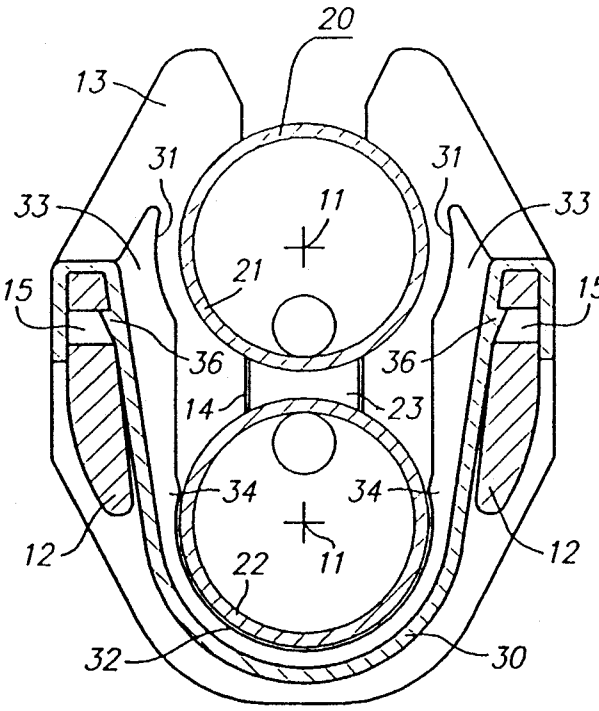
FIG. 3*a* is a section along line III—III in FIG. 1.

The twin cartridge 20 shown in FIG. 1, 2, and 3*a* has two cylinders 21, 22 of the same diameter for a 1:1 cross-section and mixing ratio. FIG. 3*b* differs from FIG. 3*a* only in showing a twin cartridge 20*a* which has two cylinders 21*a*, 21*b* of different diameters, the example shown providing a cross-section and mixing ratio of 2:1. The axis of each cylinder of the cartridge 20 in FIG. 3*a* and of the cartridge 20*a* in FIG. 3*b* aligns with the corresponding axis 11 of the plungers 10. This alignment is achieved without modification of the dispensing apparatus or holder, by special retention means and alignment provided for the storage cylinders 21, 22 and 21*a*, 21*b* with the two plungers 10, as described below. These retention means have separate grippers 31, 32, each associated with one of the plungers and dimensioned for different diameters of cylinder; in the example shown, the gripper 32 corresponds with the diameter of cylinder 22 and the gripper 31 corresponds with the larger diameter of cylinder 21*a*.

In a preferred embodiment as shown, the retention means in the holder is formed as a part of a removable guide piece 30 connected to the holder. This guide piece 30 is an injection-moulded shell-shaped plastic component placed mainly between the two struts 12, the edges of the guide piece overlapping the struts; pawllike lugs 36 on the guide piece 30 engage in slots 15 in the struts 12 and provide a snap-fit connection which can be released when necessary. On the inside of the shell-shaped guide piece 30, projecting ribs 33 formed near the front and rear end act as the retention means referred to. The ribs 33 are paired symmetrically about plane 16 on the two sides of the storage cylinders. Their edges form circular arcs 31 and 32 providing the grippers. As shown, both cartridge 20 and cartridge 20*a* fit between the paired grippers 31, 32. On the jaws of the lower gripper 32 for the (smaller) cylinder 22, the ribs 33 form retaining cams 34; for the larger-diameter cylinder 21*a*, raised ends of the ribs 33 similarly form springy retaining cams.

When a twin cartridge 20 as shown in FIG. 3*a* is inserted, the lower grippers 32 grip the lower cylinder 22 and thus determine the vertical position of the cartridge relative to the plunger axes 11, but the upper cylinder 21 remains free between the grippers 31. When a cartridge 20*a* as shown in FIG. 3*b* is inserted, the upper grippers 31 grip the larger upper cylinder 21*a* and determine the vertical position of the cartridge, but the smaller lower cylinder 22*a* remains free between the grippers 32. In either case, the nozzle piece 23 of the cartridge 20 or 20*a* is positioned laterally by the slot 14 in the face plate 13, which prevents the unrestrained storage cylinder 21 or 22*a* respectively from swinging to and fro, and thus keeps each storage cylinder perfectly aligned with its plunger. The same retention means 33 can thus be used for holding and aligning two different types of twin cartridges whose pairs of cylinders differ from each other.

The shell-shaped guide piece 30 has a vertically movable downward-projecting pin 35. A correctly inserted cartridge keeps this depressed in its lower end position as shown. This position is transmitted to a mechanism (not shown) integrated in the handle of the dispensing apparatus which prevents the plungers being advanced unless a cartridge has been correctly inserted (see U.S. Pat. No. 5,054,655 of the same applicant). With cartridge 20, the bottom cylinder 22 keeps the pin 35 depressed; in the case shown in FIG. 3*b*, the cylinder 22*a* has a rib 25 along its bottom which projects by the same amount as cylinder 22. The length of this rib 25 should be the same as the range of pin 35 but may extend the entire length of the cylinder 22*a*.

Depending on the dimensions of the grippers 31 and 32, twin cartridges with cylinders whose diameter ratios are different from those shown may also be used and kept aligned. As becomes necessary, the holder must be equipped with retention means appropriate for different shapes and sizes of cartridges, and this is readily feasible, particularly if the retention means is formed as part of interchangeable guide pieces.

Analogously, the principles described also apply if the storage cylinders of the twin cartridges are placed in the holder side by side horizontally instead of vertically above each other as described.

While the foregoing description and drawings represent the preferred embodiments of the present invention, it will be obvious to those skilled in the art that various changes and modifications may be made therein without departing from the true spirit and scope of the present invention.

I claim:

1. A dispensing apparatus for use with a cartridge having a nozzle and two parallel storage cylinders, the cylinders having parallel axes and being connected to the nozzle, the dispensing apparatus comprising:

a. a first end;

b. a nozzle guide positioned at the first end for receiving the nozzle;

c. a cartridge holder which comprises gripping means for gripping one of the two cylinders;

d. two plungers which move longitudinally and are positioned a fixed axial distance from each other;

e. activating means for activating the two plungers;

wherein the nozzle guide and the gripping means position the two cylinders so that the two plungers may each engage one of the two cylinders and move longitudinally along the respective axes at the two cylinders.

2. Dispensing apparatus in accordance with claim 1, wherein the retention means is formed as part of a guide piece removably connected to the holder.

3. Dispensing apparatus in accordance with claim 1 or 2, wherein the retention means is formed by ribs on both sides of the storage cylinders and includes edge sections shaped as circular arcs.

4. Dispensing apparatus in accordance with claim 2, wherein the ribs are plastic and formed as part of a shell-shaped guide piece by injection molding.

5. Dispensing apparatus in accordance with claim 1, wherein the guide for the nozzle piece of the cartridge has a groove at right angles to the plunger axes for guiding a rib projecting from the nozzle piece for the proper axial position of the twin cartridge.

6. A dispensing apparatus for use with a cartridge having a nozzle and two parallel storage cylinders, the cylinders having parallel axes and being connected to the nozzle, the dispensing apparatus comprising:

a. a first end;

b. a nozzle guide positioned at the first end for receiving the nozzle;

c. a cartridge holder which comprises gripping means for gripping one of the two cylinders, wherein the gripping means is formed as part of a guide piece removably connected to the holder;

d. two plungers which move longitudinally and are positioned a fixed axial distance from each other;

e. activating means for activating the two plungers;

wherein the nozzle guide and the gripping means position the two cylinders so that the two plungers may each engage one of the two cylinders and move longitudinally along the respective axes at the two cylinders.

7. The dispensing apparatus of claim 6 wherein the gripping means is formed by ribs on both sides of the storage cylinders and includes edge sections shaped as circular arcs.

8. The dispensing apparatus of claim 7 wherein the ribs are plastic an formed as part of a shell-shaped guide piece by injection molding.

* * * * *